US012742588B2

(12) United States Patent
Roberts et al.

(10) Patent No.: US 12,742,588 B2
(45) Date of Patent: Sep. 22, 2026

(54) SINGLE MIXED REFRIGERANT LNG PRODUCTION PROCESS

(71) Applicant: Honeywell LNG LLC, Wilmington, DE (US)

(72) Inventors: Mark Julian Roberts, Whitehall, PA (US); Annemarie Ott Weist, Macungie, PA (US); Bo Jin, Orefield, PA (US); Brian James Barr, Emmaus, PA (US)

(73) Assignee: HONEYWELL LNG LLC, Wilmington, DE (US)

( * ) Notice: Subject to any disclaimer, the term of this patent is extended or adjusted under 35 U.S.C. 154(b) by 403 days.

(21) Appl. No.: 17/682,534

(22) Filed: Feb. 28, 2022

(65) Prior Publication Data

US 2023/0272971 A1 Aug. 31, 2023

(51) Int. Cl.
*F25J 1/00* (2006.01)
*F25J 1/02* (2006.01)

(52) U.S. Cl.
CPC ..... *F25J 1/0052* (2013.01); *F25J 1/0022* (2013.01); *F25J 1/0057* (2013.01); *F25J 1/0212* (2013.01); *F25J 1/0249* (2013.01); *F25J 1/0262* (2013.01); *F25J 1/0281* (2013.01); *F25J 1/0291* (2013.01); *F25J 1/0294* (2013.01); *F25J 1/0298* (2013.01)

(58) Field of Classification Search
CPC ..... F25J 1/0022; F25J 1/0052; F25J 1/0055; F25J 1/0264; F25J 1/0295; F25J 2270/66; F28D 1/0417; F28D 1/0443; F28D 7/0075; F28D 7/0083; F28D 1/0472
See application file for complete search history.

(56) References Cited

U.S. PATENT DOCUMENTS 4,334,902 A 6/1982 Paradowski
4,445,917 A * 5/1984 Chiu ..... F25J 1/0215 62/625
4,541,852 A * 9/1985 Newton ..... F25J 1/0267 62/613
6,334,334 B1 1/2002 Stockmann et al.
(Continued)

FOREIGN PATENT DOCUMENTS

CN 103216998 12/2015
EP 1092932 4/2001
(Continued)

OTHER PUBLICATIONS

Tak, Kyungjae, et al, "Comparison of Multistage Compression Configurations for Single Mixed Refrigerant Processes", Industrial & Engineering Chemistry Research, 2015, 9992-10000.
(Continued)

*Primary Examiner* — Brian M King
(74) *Attorney, Agent, or Firm* — CANTOR COLBURN LLP

(57) ABSTRACT

A simple and efficient single mixed refrigerant process for cooling and liquefying a hydrocarbon feed stream, such as natural gas. The process employs a closed-loop single mixed refrigerant process for refrigeration duty. The refrigerant compressed to a high pressure using at least three stages of compression and two intercoolers (both producing liquid). A hydraulic turbine is used to expand the high pressure refrigerant before it flows into the main heat exchanger.

21 Claims, 4 Drawing Sheets

(56) References Cited

U.S. PATENT DOCUMENTS

| | | | | |
|---|---|---|---|---|
| 10,139,157 | B2 | 11/2018 | Currence | |
| 2006/0162378 | A1* | 7/2006 | Roberts | F25J 1/0055 62/612 |
| 2010/0107684 | A1* | 5/2010 | Minta | F25J 1/0297 62/623 |
| 2012/0247147 | A1 | 10/2012 | Kerber et al. | |
| 2014/0053600 | A1* | 2/2014 | Jung | F25J 1/023 62/611 |
| 2016/0313057 | A1* | 10/2016 | Roberts | F25J 1/0278 |
| 2016/0327335 | A1 | 11/2016 | Brostow et al. | |
| 2018/0283773 | A1* | 10/2018 | Mondkar | F25J 1/0257 |
| 2022/0065538 | A1* | 3/2022 | Kanazawa | F28D 1/053 |

FOREIGN PATENT DOCUMENTS

| | | | | |
|---|---|---|---|---|
| EP | 1367350 | A1 * | 12/2003 | F25J 1/0087 |
| GB | 895094 | A | 5/1962 | |
| KR | 20200130599 | | 11/2020 | |
| NO | 20140358 | | 9/2015 | |
| WO | 2015140197 | A2 | 9/2015 | |

OTHER PUBLICATIONS

F. Fazlollahi, et al, "Transient natrual gas liquefaction and its application to CCC-ES (energy storage with cryogenic carbon capture (TM)", Energy Elsevier, Amsterdam, NL, vol. 103, Mar. 25, 2016, 369-384.

M. A. Qyyum, et al, "Energy efficient enhancement of a single mixed refrigerant LNG process using a novel hydraulic turbine", Energy Elsevier, Amsterdam, NL, vol. 144, Dec. 29, 2017, 968-976.

F. Almeida-Trasvina, et al, "Development of an Energy-Efficient Single Mixed Refrigerant Cycle for Small-Scale LNG Production", Industrial & Engineering Chemistry Research, vol. 60, No. 32, Aug. 18, 2021, 12049-12067.

Japan Office Action (translation) for application JP2024550567 Issued Aug. 8, 2025, 4 pages.

* cited by examiner

| | 1 | 2 | 3 | 4 |
|---|---|---|---|---|
| | Figure 3 (Prior Art) | Figure 3 with Turbine | Figure 1 without Turbine | Figure 1 |
| Expansion Device (X34) | Joule Thompson Valve | Hydraulic Turbine | Joule Thompson Valve | Hydraulic Turbine |
| Compressor Stages | 2 | 2 | 3 | 3 |
| Relative Power | 1.132 | 1.067 | 1.076 | 1.000 |
| Benefit of Hydraulic Turbine with Two Stages | - | 6.0% | | |
| Benefit of Three Stages without Hydraulic Turbine | - | | 5.2% | |
| Benefit of Both Hydraulic Turbine and Three Stages | - | | | 13.2% |
| Optimized Compressor X14 Discharge Pressure, PSIA | 719 | 1090 | 795 | 1100 |

Figure 4

SINGLE MIXED REFRIGERANT LNG PRODUCTION PROCESS

BACKGROUND

Production of liquefied natural gas (LNG) through indirect heat exchange against a single mixed refrigerant (SMR) is well-known in the art. A simple, well-known prior art SMR process is described herein and shown in FIG. 3.

There have been many attempts to improve the efficiency of SMR processes. For example, U.S. Pat. No. 10,139,157 describes a single mixed refrigerant LNG production cycle in which a single mixed refrigerant stream is cooled and liquefied in a cryogenic exchanger, before passing through a Joule-Thompson valve. Similarly, U.S. Pat. No. 6,334,334 teaches a single mixed refrigerant LNG production cycle in which two mixed refrigerant (vapor and liquid) streams are cooled and liquefied separately in cryogenic exchangers before the resulting liquid is passed through a work producing turbine. The resulting liquefied vapor stream passes through a Joule-Thompson valve. In this process, three compression stages are provided, with liquid produced in the first intercooler being mixed with the discharge of the second stage then cooled in a second intercooler to produce a second liquid and vapor stream, which is subsequently separated. The liquid stream is sent directly to a cryogenic exchanger. In addition, only a portion of the mixed refrigerant is passed through the work producing turbine.

Many of the attempts to improve the efficiency of the SMR process results in processes that are complex to build and/or operate. Accordingly, there is a need for an improved SMR process that better balances increased efficiency and complexity.

SUMMARY

Disclosed herein is a simple and efficient SMR process that cools and liquefies a single high pressure ambient two phase mixed refrigerant stream in a cryogenic heat exchanger, expands the liquid refrigerant at the cold end, then vaporizes it in the exchanger to provide refrigeration duty to a natural gas stream being liquefied and a high-pressure mixed refrigerant stream.

An important feature of the exemplary embodiments disclosed herein is a synergistic combination of three stages of compression, two intercoolers (both producing liquid), and the use of a hydraulic turbine to expand the refrigerant before it flows into the main heat exchanger. Providing three stages of compression (with liquid formation as described) enables a high mixed refrigerant discharge pressure to be achieved efficiently. The high mixed refrigerant discharge pressure improved the refrigeration performance of hydraulic turbine and unexpectedly improved the performance of liquefaction system.

Several aspects of the systems and methods are outlined below.

Aspect 1—A method for liquefying a hydrocarbon stream using a mixed refrigerant, the method comprising:

(a) cooling and condensing the hydrocarbon stream and a cooled two-phase high pressure refrigerant stream in a main heat exchanger against an expanded refrigerant stream to form a liquefied hydrocarbon stream, a condensed refrigerant stream, and a vaporized refrigerant stream;

(b) compressing the vaporized refrigerant stream in a first compression stage to a first pressure to form a low pressure compressed refrigerant stream;

(c) cooling the low pressure compressed refrigerant in a first ambient cooler to form a cooled two-phase refrigerant stream;

(d) separating the cooled two-phase refrigerant stream into a first cooled vapor stream and a first cooled liquid stream;

(e) compressing the first cooled vapor stream in a second compression stage to a second pressure form a medium pressure compressed stream;

(f) pumping the first cooled liquid stream to the second pressure to form a pumped first cooled liquid stream;

(g) combining the pumped first cooled liquid stream with the medium pressure refrigerant stream to form a combined medium pressure refrigerant stream;

(h) cooling the combined medium pressure refrigerant stream in a second ambient cooler to form a cooled combined medium pressure refrigerant stream;

(i) separating the cooled combined medium pressure refrigerant stream into a second cooled vapor stream and a second cooled liquid stream;

(j) compressing the second cooled vapor stream in a third compression stage to a third pressure to form a high-pressure compressed stream;

(k) pumping the second cooled liquid stream to the third pressure to form a pumped second cooled liquid stream;

(l) combining the pumped second cooled liquid stream with the high-pressure compressed stream to form a two-phase high-pressure refrigerant stream;

(m) cooling the two-phase high-pressure refrigerant stream in a third ambient cooler to form the cooled two-phase high-pressure refrigerant stream; and (n) expanding the condensed refrigerant stream through a hydraulic turbine to form the expanded refrigerant stream.

Aspect 2: The method of Aspect 1, wherein the expanded refrigerant stream provides the sole refrigeration duty for step (a).

Aspect 3: The method of any of Aspects 1-2, wherein flow of the refrigerant in steps (a) through (n) defines a closed-loop refrigeration cycle and all of the refrigerant flows through the hydraulic turbine in step (n).

Aspect 4: The method of any of Aspects 1-3, wherein the main heat exchanger comprises a warm end and a cold end and the expanded refrigerant stream is introduced into the main heat exchanger at the cold end.

Aspect 5: The method of any of Aspects 1-4, wherein the vaporized refrigerant stream has a first flow rate in step (b) and the expanded refrigerant stream has a second flow rate in step (n), the first flow rate being equal to the second flow rate.

Aspect 6: The method of any of Aspects 1-5, wherein the cooled two-phase high pressure refrigerant stream has a pressure of at least 1000 PSIA (68.95 bara).

Aspect 7: The method of any of Aspects 1-6, wherein the composition of the refrigerant is the same in the vaporized refrigerant stream, the two phase high pressure refrigerant stream, the condensed refrigerant stream, and the expanded refrigerant stream.

Aspect 8: The method of any of Aspect 1-7, wherein the main heat exchanger comprises a warm bundle and a cold bundle and the method further comprises:

(o) providing a first refrigeration duty in the warm bundle when performing step (a)

(p) providing a second refrigeration duty in the cold bundle when performing step (a), the second refrigeration duty being less than the first refrigeration duty.

Aspect 9: The method of any of Aspects 1-8, wherein the warm bundle and the cold bundle are each contained within separate shells.

Aspect 10: The method of any of Aspects 1-9, wherein the main heat exchanger further comprises a middle bundle and the method further comprises:

(q) providing a third refrigeration duty in the middle bundle when performing step (a), the third refrigeration duty being less than the first refrigeration duty.

Aspect 11: The method of any of Aspects 1-10, wherein the warm bundle, the cold bundle, and the middle bundle are each contained within separate shells.

Aspect 12: The method of any of Aspects 1-11, wherein the hydrocarbon stream comprises natural gas.

Aspect 13: The method of any of any of Aspects 1-12, wherein step (i) further comprises selectively expanding the condensed refrigerant stream through an expansion valve located on a bypass circuit instead of through the hydraulic turbine.

Aspect 14: A method for liquefying a hydrocarbon stream using a mixed refrigerant, the method comprising:

(a) cooling and condensing the hydrocarbon stream and a cooled two-phase high pressure refrigerant stream in a main heat exchanger against an expanded refrigerant stream to form a liquefied hydrocarbon stream, a condensed refrigerant stream, and a vaporized refrigerant stream;

(b) compressing the vaporized refrigerant stream in a first compression stage to a first pressure to form a low pressure compressed refrigerant stream;

(c) cooling the low pressure compressed refrigerant in a first ambient cooler to form a cooled two-phase refrigerant stream;

(d) separating the cooled two-phase refrigerant stream into a first cooled vapor stream and a first cooled liquid stream;

(e) compressing the first cooled vapor stream in a second compression stage to a second pressure form a high-pressure compressed stream having a pressure of at least 1000 PSIA (68.95 bara);

(f) pumping the first cooled liquid stream to the second pressure to form a pumped first cooled liquid stream;

(g) combining the pumped first cooled liquid stream with the high pressure refrigerant stream to form a combined high-pressure refrigerant stream;

(h) cooling the combined high-pressure refrigerant stream in a second ambient cooler to form a cooled two phase high pressure refrigerant stream; and (i) expanding the condensed refrigerant stream through a hydraulic turbine to form the expanded refrigerant stream.

Aspect 15: The method of Aspect 14, wherein the cooled two-phase high pressure refrigerant stream, the expanded refrigerant stream, and the vaporized refrigerant stream all consist of the mixed refrigerant.

Aspect 16: The method of any of Aspects 14-15, wherein the expanded refrigerant stream provides the sole refrigeration duty for step (a).

Aspect 17: The method of any of Aspects 14-16, wherein flow of the refrigerant in steps (a) through (i) defines a closed-loop refrigeration cycle and all of the refrigerant flows through the hydraulic turbine in step (i).

Aspect 18: The method of any of Aspects 14-17, wherein the vaporized refrigerant stream has a first flow rate in step (a) and the expanded refrigerant stream has a second flow rate in step (i), the first flow rate being equal to the second flow rate.

Aspect 19: The method of any of Aspects 14-18, wherein the composition of the refrigerant is the same in the vaporized refrigerant stream, the cooled two phase high pressure refrigerant stream, the condensed refrigerant stream, and the expanded refrigerant stream.

Aspect 20: A method of designing and fabricating a system for liquefying natural gas using a closed loop single mixed refrigerant process that supplies refrigeration duty to a cryogenic heat exchanger having a plurality of coil wound bundles, each of the plurality of coil wound bundles having an overall tube length, the method comprising:

(a) selecting a refrigeration duty for each of a plurality of coil wound bundles that minimizes differences in the overall tube length of each of the plurality of coil wound bundles; and (b) fabricating the system to provide the refrigeration duties selected in step (a);

wherein the sole refrigeration duty for the cryogenic heat exchanger is a stream of the single mixed refrigerant that has been compressed to a pressure of at least 1000 PSIA (68.95 bara) and expanded by a hydraulic turbine.

Aspect 21: The method of Aspect 20, wherein the plurality of coil wound bundles comprises a warm bundle and a cold bundle, the selected refrigeration duty of the warm bundle being less than the selected refrigeration duty of the cold bundle.

BRIEF DESCRIPTION OF THE DRAWING(S)

The present invention will hereinafter be described in conjunction with the appended drawing figures wherein like numerals denote like elements.

FIG. 4 is a table comparing key parameters from the prior art process shown in FIG. 3 with several variants of exemplary embodiments shown in FIG. 1.

DETAILED DESCRIPTION OF THE PREFERRED EMBODIMENTS

Figure 1:
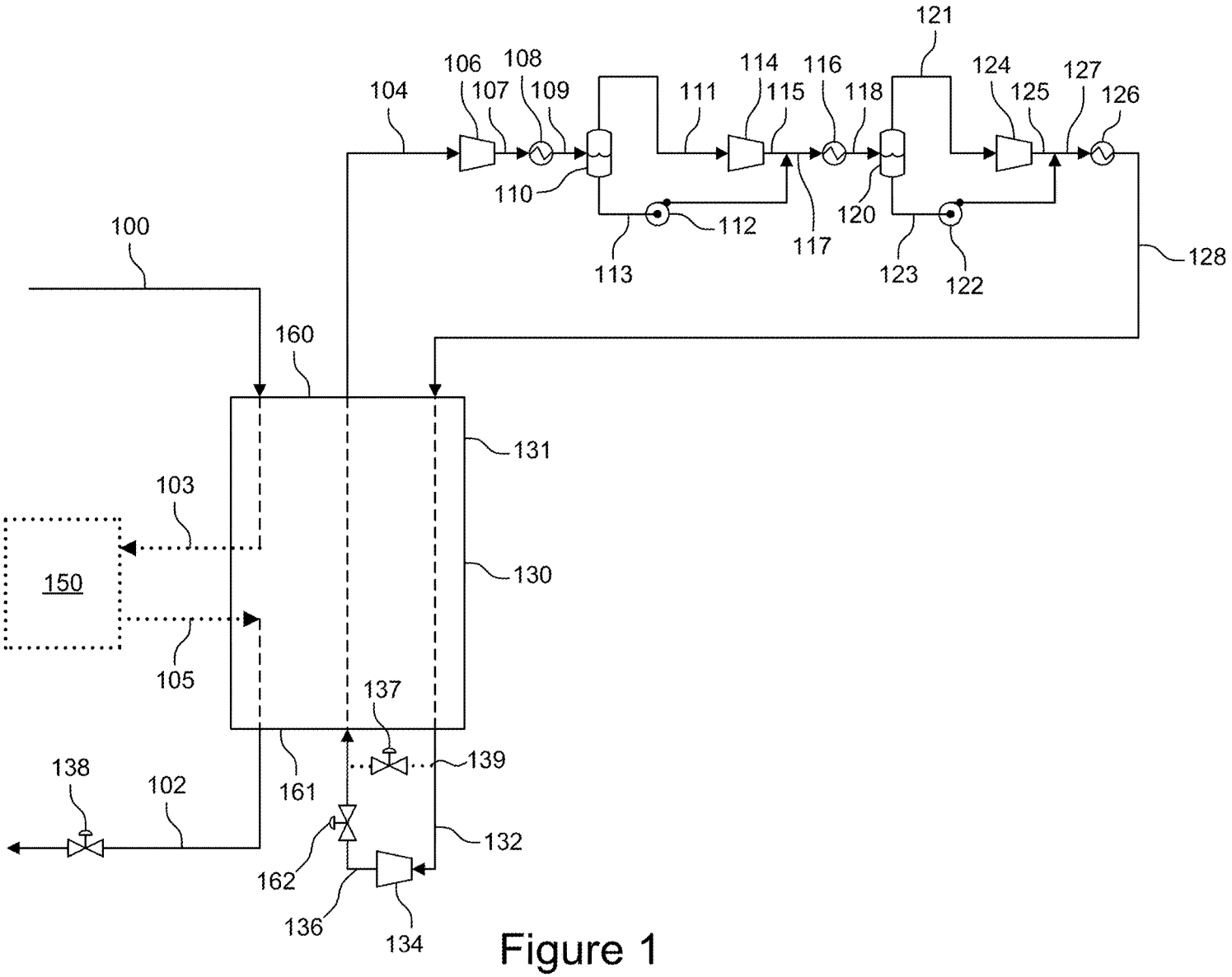
FIG. 1 is a schematic flow diagram depicting an improved SMR process.

The ensuing detailed description provides preferred exemplary embodiments only, and is not intended to limit the scope, applicability, or configuration of the invention.

Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

In order to aid in describing the invention, directional terms may be used in the specification and claims to describe portions of the present invention (e.g., upper, lower, left, right, etc.). These directional terms are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

Unless otherwise indicated, the articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

Unless otherwise stated herein, introducing a stream at a location is intended to mean introducing substantially all of the said stream at the location. All streams discussed in the specification and shown in the drawings (typically represented by a line with an arrow showing the overall direction of fluid flow during normal operation) should be understood to be contained within a corresponding conduit. Each conduit should be understood to have at least one inlet and at least one outlet. Further, each piece of equipment should be understood to have at least one inlet and at least one outlet.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

As used in the specification and claims, the term "flow communication" is intended to mean that two or more elements are connected (either directly or indirectly) in a manner that enables fluids to flow between the elements, including connections that may contain valves, gates, tees, or other devices that may selectively restrict, merge, or separate fluid flow.

The term "natural gas", as used in the specification and claims, means a hydrocarbon gas mixture consisting primarily of methane.

The terms "hydrocarbon", "hydrocarbon gas", or "hydrocarbon fluid", as used in the specification and claims, means a gas/fluid comprising at least one hydrocarbon and for which hydrocarbons comprise at least 80%, and more preferably at least 90% of the overall composition of the gas/fluid.

The term "mixed refrigerant", as used in the specification and claims, means a mixture of hydrocarbons, typically comprising hydrocarbon components containing one to five carbon atoms and may contain saturated and/or non-saturated components and/or straight chain and/or branched components, and nitrogen.

The term "ambient cooler", as used in the specification and claims, means a heat exchange device the cools a fluid against an ambient fluid (typically ambient air).

As used in the specification and claims, the terms "high-high", "high", "medium", "low", and "low-low" are intended to express relative values for a property of the elements with which these terms are used. For example, a high-high pressure stream is intended to indicate a stream having a higher pressure than the corresponding high pressure stream or medium pressure stream or low pressure stream described or claimed in this application. Similarly, a high pressure stream is intended to indicate a stream having a higher pressure than the corresponding medium pressure stream or low pressure stream described in the specification or claims, but lower than the corresponding high-high pressure stream described or claimed in this application. Similarly, a medium pressure stream is intended to indicate a stream having a higher pressure than the corresponding low pressure stream described in the specification or claims, but lower than the corresponding high pressure stream described or claimed in this application.

Unless otherwise stated herein, any and all percentages identified in the specification, drawings and claims should be understood to be on a mass percentage basis. Unless otherwise stated herein, any and all pressures identified in the specification, drawings and claims should be understood to mean gauge pressure.

As used in the specification and claims, the term "compression system" is defined as one or more compression stages. For example, a compression system may comprise multiple compression stages within a single compressor. In an alternative example, a compression system may comprise multiple compressors.

As used herein, the term "hydraulic turbine" is intended to refer to a work producing liquid expander. In the context of this invention, the primary purpose of the hydraulic turbine is to provide refrigeration to the process by removing enthalpy from the refrigerant stream, and the work produced may be recovered using an electrical generator, used to compress another fluid, or simply dissipated as heat released to the surroundings.

FIG. 1 shows a single mixed refrigerant (SMR) natural gas liquefaction process. In this exemplary process, a feed gas stream 100 and a two phase high pressure refrigerant stream 128 is cooled against an expanded refrigerant stream 136. For the processes of FIGS. 1 and 2, the term "refrigerant" should be understood to mean a mixed refrigerant.

In this example, the feed gas stream 100 is natural gas, which is preferably pre-treated to remove water, acid gases (carbon dioxide and sulfur dioxide) and freezable heavy hydrocarbons. The feed gas stream 100 is preferably near ambient temperature or may have been pre-cooled by another process using known refrigeration techniques (fluid boiling, gas expansion etc.). Typically, the feed gas stream 100 enters a warm end 160 of the cryogenic heat exchanger 130 at a pressure of 40 bara to 80 bara, then exits a cold end 161 of the cryogenic heat exchanger 130 as a product stream 102 in liquid phase, at a temperature of typically between −140 degrees C. and −150 degrees C. The product stream 102 preferably passes through pressure reduction device 138 which may be a Joule-Thompson valve or a work producing hydraulic turbine before being sent to storage (not shown).

In this exemplary process, the cryogenic heat exchanger 130 consists of a single shell 131. Examples of suitable types of heat exchanger types for the cryogenic heat exchanger 130 include a plate and fin heat exchanger or a coil wound heat exchanger. In the case of a coil wound heat exchanger, the expanded refrigerant stream 136 flows through a shell side of the cryogenic heat exchanger 130. If the cryogenic heat exchanger 130 is a plate fin-style exchanger, it may be desirable to employ devices to ensure even distribution of two phase high pressure refrigerant stream 128 among parallel passages and/or exchangers using techniques well known in the art, such as a phase separator liquid pumps and the like.

The feed gas stream 100 could optionally be removed from the cryogenic heat exchanger 130 at an intermediate location (stream 103) and sent to a separation device 150 for heavy hydrocarbon removal, then a predominately methane stream 105 is reintroduced into cryogenic heat exchanger 130.

After providing refrigeration duty, a vapor refrigerant stream 104 is withdrawn from the warm end 160 of the cryogenic heat exchanger 130. The vapor refrigerant stream 104 is preferable at near-ambient temperature and at a pressure of 3-5 bara. The vapor refrigerant stream 104 is then compressed in compressor stage 106 to a pressure typically from 10 to 20 bara, forming a low-pressure refrigerant stream 107. The low-pressure refrigerant stream 107 is then cooled by ambient cooler 108, using cooling water or air. The resulting cooled two-phase refrigerant stream 109 is separated into a liquid stream 113 and a vapor stream 111, using a separator 110. The vapor stream 111 is compressed (via compression stage 114) to a pressure typically between 25 and 30 bara to form a medium pressure refrigerant stream 115. The liquid stream 113 is pumped (using pump 112) to substantially the same pressure as the medium pressure refrigerant stream 115 then combined with the medium pressure refrigerant stream 115. The combined stream 117 is then cooled by ambient cooler 116 using cooling water or air.

The resulting two-phase refrigerant stream 118 is separated into a liquid stream 123 and a vapor stream 121 using a separator 120. The vapor stream 121 is further compressed (via a compression stage 124) to a pressure typically between 40 and 70 bara for form a high pressure refrigerant stream 125. The liquid stream 123 is pumped (via pump 122) to substantially the same pressure as the high pressure refrigerant stream 125, then recombined with the high pressure refrigerant stream 125. The combined stream 127 is then cooled by ambient cooler 126 using cooling water or air to form the two phase high pressure refrigerant stream 128.

The two phase high pressure refrigerant stream 128 is then cooled and condensed in the cryogenic heat exchanger 130, exiting as a condensed refrigerant stream 132 in liquid phase and at a temperature of typically between −140 degrees C. and −150 degrees C. The condensed refrigerant stream 132 is sent to a hydraulic turbine 134 and expanded to form an expanded refrigerant stream 136. Optionally, the hydraulic turbine 134 may have a single-phase liquid outlet followed by a valve or may include a work producing liquid expander with a two-phase outlet.

An optional bypass circuit 139 with an expansion valve 137 (such as a Joule-Thompson valve) could be provided to enable the system to continue to function when the hydraulic turbine 134 is being serviced or in the case of a failure. In addition, an optional expansion valve 162 (such as a Joule-Thompson valve) could be provided downstream from the hydraulic turbine 134 to provide for further expansion of the expanded refrigerant stream 136. The optional bypass circuit 139 and optional expansion valve 162 could also be included in the embodiment shown in FIG. 2.

The expanded refrigerant stream 136 is then introduced into the cold end 161 of the cryogenic heat exchanger 130, vaporized (typically at a pressure of 3-5 bara) (providing refrigeration duty for the process), and exits the warm end 160 as the vapor refrigerant stream 104.

Figure 2:
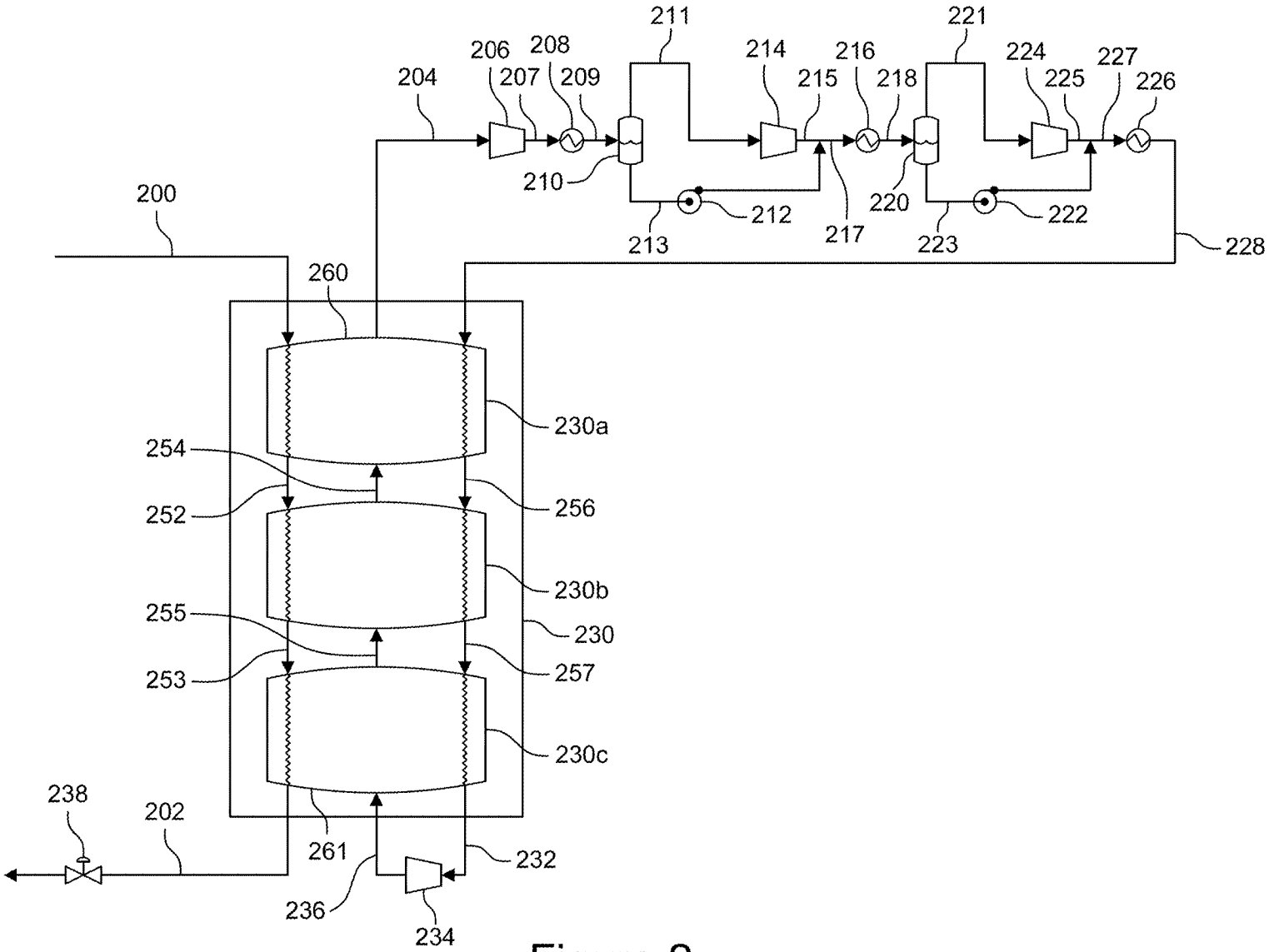
FIG. 2 is a schematic flow diagram depicting the improved SMR process of FIG. 1, modified to include a coil-wound heat exchanger with multiple shells.

In FIG. 2, all items are labeled with reference numerals of the format 2XX. Unless otherwise described herein, elements in FIG. 2 with a reference numeral having the same last two digits as an element in FIG. 1 should be understood to be substantially the same as the corresponding element of FIG. 1. For example, the separator 210 of FIG. 2 is substantially the same as the separator 110 of FIG. 1.

The process of FIG. 2 is very similar to the process of FIG. 1, with the exception of the cryogenic heat exchanger 130 of FIG. 1 being replaced by a cryogenic heat exchanger 230 having three shells 230*a*, 230*b* and 230*c*, each arranged in series and each containing a coil wound tube bundle (not shown). The duty may be split between two or three coil wound exchangers in separate shells with interconnecting piping (253-257) as shown. Alternatively, the cryogenic heat exchanger 230 could be built with two or three coil wound bundles in a common shell. Splitting the service may help to keep the individual bundles within manufacturing limitations, for example limitations on the maximum length to stay within the capability of current manufacturing facilities. The structure of the cryogenic heat exchanger 230 enables a refrigeration duty to be split unevenly between the bundles and selected in a manner that reduces manufacturing time.

If all of the shells 230*a*, 230*b* and 230*c* and bundles of the cryogenic heat exchanger 230 are fabricated at the same time, overall fabrication time is dictated by the bundle that requires the most time to fabricate. If refrigeration duty is split equally among the bundles contained within each of the shells 230*a*, 230*b* and 230*c*, then the bundle contained within the shell 230*a* would take longer to fabricate than the bundles contained within shells 230*b* and 230*c*. The feed gas stream 200 and the two phase high pressure refrigerant stream 228 have a relatively high vapor fraction and relatively low density when flowing through shell 230*a*, as compared to those same streams when flowing through shell 230*b* or 230*c*. This is due to a density increase as the streams 200, 228 are cooled and condensed. This results in the bundle of shell 230*a* requiring more tubes than the bundles of shell 230*b* or 230*c*. If refrigeration duty is shifted from shell 230*a* to shells 230*b* and 230*c* by making the bundle contained within shell 230*a* shorter and increasing the length of the bundles contained within shells 230*b* and 230*c*, the same pressure drop can be achieved with fewer tubes because the length of the tubes is reduced. This reduces the fabrication time of the bundle for shell 230*a*, and therefore, the overall manufacturing time.

For example, for the exemplary embodiment shown in FIG. 2, the duty may be split such that shell 230*a* has 27% of the total duty, shell 230*b* has 35% of the total duty and shell 230*c* has 38% of the total duty. In general, for a SMR system having three heat exchanger shells, the duty split preferably results in the warmest shell (shell 203*a* in FIG. 2) having less than 30% of the total refrigeration duty of the heat exchanger. Similarly, for an SMR system having only two heat exchanger shells, the duty split preferably results in the warmest shell having less than 45% of the total refrigeration duty of the heat exchanger.

Figure 3:
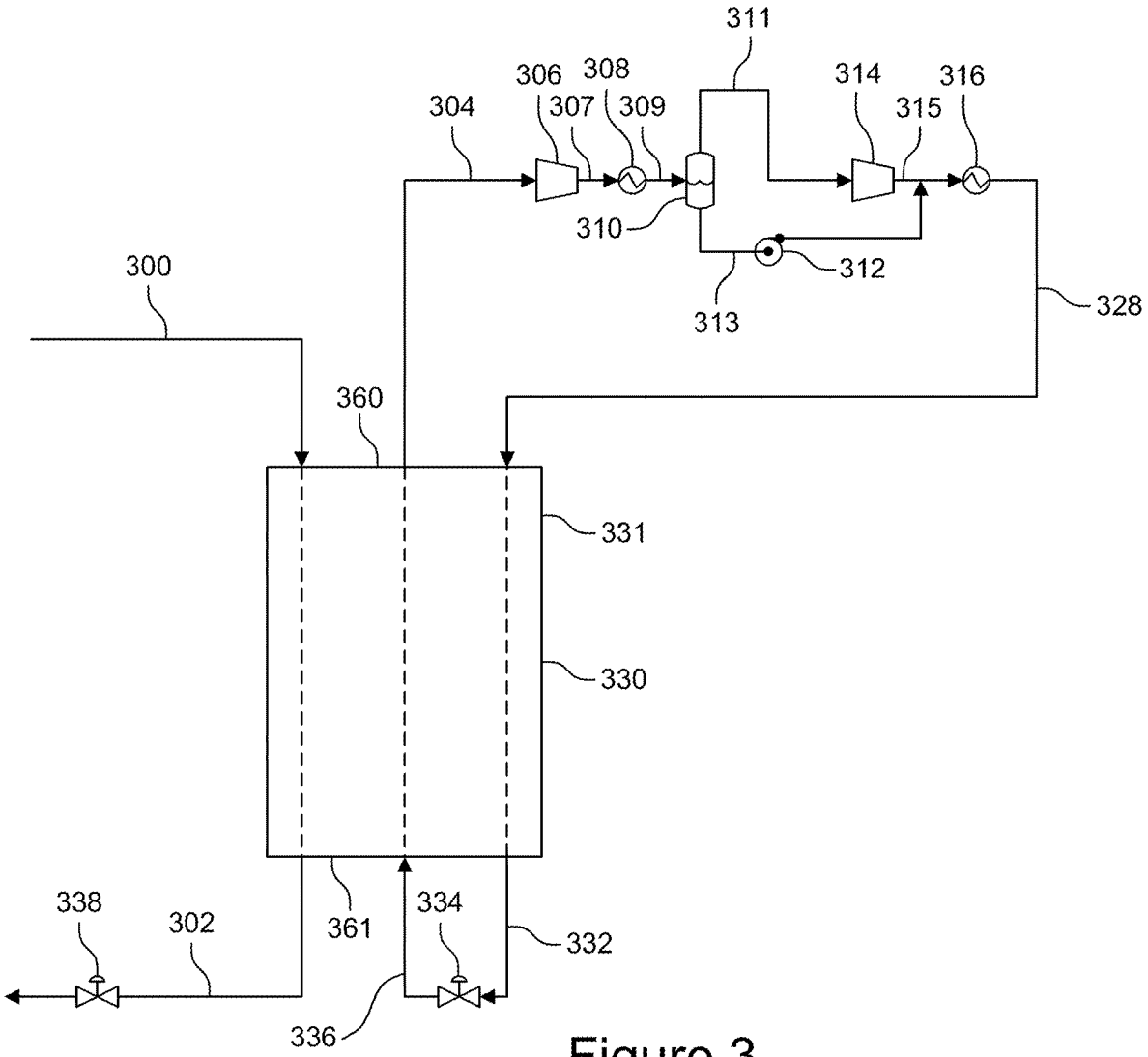
Figure 3 (Prior Art)
FIG. 3 is a schematic flow diagram depicting a prior art SMR LNG process.

FIG. 3 shows a prior art single mixed refrigerant process that is often used in small-scale and mid-scale LNG plants. In this process, two compression stages 306, 314 and a single intercooler 308 and drum 310 are used. Liquid 311 from the drum 310 is pumped (using pump 312), then mixed with the vapor stream 313 from the final compression stage 314 before being cooled in an aftercooler 316. A Joule-Thompson valve 334 is used to expand liquefied mixed refrigerant stream 332 before it is sent to exchanger 330 where it is vaporized to provide refrigeration. This process is provided to form a basis for comparing performance with the processes disclosed herein in the examples provided below.

In FIG. 3, all items are labeled with reference numerals of the format 3XX. Unless otherwise described herein, elements in FIG. 3 with a reference numeral having the same last two digits as an element in FIG. 1 should be understood to be substantially the same as the corresponding element of FIG. 1. For example, the separator 310 of FIG. 2 is substantially the same as the separator 110 of FIG. 1.

EXAMPLE

FIG. 4 is a table that compares, for a fixed production rate, the prior art process shown in FIG. 3 with several variants of exemplary embodiments shown in FIG. 1. The data in FIG. 4 was generated in a process simulator with the operating parameters of pressures, temperatures and mixed refrigerant composition selected using a numerical optimization program. Design assumptions such as LNG production rate, ambient temperature, pressure drops, exchanger minimum approach temperatures, and compressor efficiencies were the same for all four examples. The relative power value for each configuration is a ratio of the total power required to operate the system in each configuration to the power required to operate the system using the embodiment shown in FIG. 2.

As shown in columns 1 and 2, there is a 6.0% benefit (i.e., reduction in total power requirement) to adding a hydraulic turbine to the prior art process of FIG. 3. A comparison of columns 1 and 3 shows a 5.2% benefit to adding a third compression stage, second intercooler and second pump to the prior art process of FIG. 3. Based on these results, the total expected benefit of the process of FIG. 1 versus that of FIG. 3 would be expected to be 11.2%. The actual improvement was 13.2% —significantly greater than expected. This unexpected result is believed to be due to the synergistic effect of providing a higher mixed refrigerant discharge pressure (due to the additional compression stage 124) to the hydraulic turbine 134. These modeled calculations did not account for any recovery of work performed by the hydraulic turbine 134. Accordingly, it is possible that additional benefit could be realized from the embodiments that include a hydraulic turbine.

As such, an invention has been disclosed in terms of preferred embodiments and alternate embodiments thereof. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A method for liquefying a hydrocarbon stream using a mixed refrigerant, the method comprising:

(a) cooling and condensing the hydrocarbon stream and a cooled two-phase high pressure refrigerant stream in a main heat exchanger against an expanded refrigerant stream to form a liquefied hydrocarbon stream, a condensed refrigerant stream, and a vaporized refrigerant stream, wherein the main heat exchanger comprises a plurality of coil wound bundles;

(b) compressing the vaporized refrigerant stream in a first compression stage to a first pressure to form a low pressure compressed refrigerant stream;

(c) cooling the low pressure compressed refrigerant in a first ambient cooler to form a cooled two-phase refrigerant stream;

(d) separating the cooled two-phase refrigerant stream into a first cooled vapor stream and a first cooled liquid stream;

(e) compressing the first cooled vapor stream in a second compression stage to a second pressure to form a medium-pressure compressed stream;

(f) pumping the first cooled liquid stream to the second pressure to form a pumped first cooled liquid stream;

(g) combining the pumped first cooled liquid stream with the medium pressure refrigerant stream to form a combined medium-pressure refrigerant stream;

(h) cooling the combined medium-pressure refrigerant stream in a second ambient cooler to form a cooled combined medium pressure refrigerant stream;

(i) separating the cooled combined medium pressure refrigerant stream into a second cooled vapor stream and a second cooled liquid stream;

(j) compressing the second cooled vapor stream in a third compression stage to a third pressure to form a high-pressure compressed stream;

(k) pumping the second cooled liquid stream to the third pressure to form a pumped second cooled liquid stream;

(l) combining the pumped second cooled liquid stream with the high-pressure compressed stream to form a two-phase high-pressure refrigerant stream;

(m) cooling the two-phase high-pressure refrigerant stream in a third ambient cooler to form the cooled two-phase high-pressure refrigerant stream; and (n) expanding the condensed refrigerant stream to form the expanded refrigerant stream; and (o) selecting a refrigeration duty for each bundle of the plurality of coil wound bundles that reduces differences in an overall tube length of each bundle of the plurality of coil wound bundles as compared to each bundle of the plurality of coil wound bundles having an identical refrigeration duty.

2. The method of claim 1, wherein the expanded refrigerant stream provides the sole refrigeration duty for step (a).

3. The method of claim 1, wherein the vaporized refrigerant stream has a first flow rate in step (b) and the expanded refrigerant stream has a second flow rate in step (n), the first flow rate being equal to the second flow rate.

4. The method of claim 1, wherein the cooled two-phase high pressure refrigerant stream has a pressure of at least 1000 PSIA (68.95 bara).

5. The method of claim 1, wherein the composition of the refrigerant is the same in the vaporized refrigerant stream, the two phase high pressure refrigerant stream, the condensed refrigerant stream, and the expanded refrigerant stream.

6. The method of claim 1, wherein the plurality of coil wound bundles includes a warm bundle and a cold bundle and wherein selecting the refrigeration duty of each bundle of the plurality of coil wound bundles comprises selecting a refrigeration duty of the warm bundle and the cold bundle such that the refrigeration duty of the cold bundle is less than the refrigeration duty of the warm bundle.

7. The method of claim 6, wherein the warm bundle and the cold bundle are each contained within separate shells.

8. The method of claim 6, wherein the plurality of coil wound bundles further comprises a middle bundle and wherein selecting the refrigeration duty of each bundle of the plurality of coil wound bundles further comprises selecting a refrigeration duty of the middle bundle such that the refrigeration duty of the middle bundle is less than the refrigeration warm bundle.

9. The method of claim 8, wherein the warm bundle, the cold bundle, and the middle bundle are each contained within separate shells.

10. The method of claim 1, further comprising fabricating the system to provide the refrigeration duties selected in step (o) prior to performing step (a).

11. The method of claim 10, wherein the expanded refrigerant stream provides the sole refrigeration duty for step (a).

12. The method of claim 1, wherein the expanded refrigerant stream provides the sole refrigeration duty for step (a), and wherein the cooled two-phase high pressure refrigerant stream has a pressure of at least 1000 PSIA (68.95 bara).

13. The method of claim 1, wherein the expanding of the condensed refrigerant stream is provided by a hydraulic turbine, an expansion valve, or a combination thereof to form the expanded refrigerant stream.

14. The method of claim 13, wherein flow of the refrigerant in steps (a) through (n) defines a closed-loop refrigeration cycle and all of the refrigerant flows through a hydraulic turbine, a expansion valve, or a combination thereof in step (n).

15. The method of claim 14, wherein the main heat exchanger comprises a warm end and a cold end and the expanded refrigerant stream is introduced into the main heat exchanger at the cold end.

16. The method of claim 1, wherein the expanding of the condensed refrigerant stream is provided by a hydraulic turbine to form the expanded refrigerant stream.

17. A method for liquefying a hydrocarbon stream using a mixed refrigerant, the method comprising:

(a) cooling and condensing the hydrocarbon stream and a cooled two-phase high pressure refrigerant stream in a main heat exchanger against an expanded refrigerant stream to form a liquefied hydrocarbon stream, a condensed refrigerant stream, and a vaporized refrigerant stream, wherein the main heat exchanger comprises a plurality of coil wound bundles;

(b) compressing the vaporized refrigerant stream in a first compression stage to a first pressure to form a low pressure compressed refrigerant stream;

(c) cooling the low pressure compressed refrigerant in a first ambient cooler to form a cooled two-phase refrigerant stream;

(d) separating the cooled two-phase refrigerant stream into a first cooled vapor stream and a first cooled liquid stream;

(e) compressing the first cooled vapor stream in a second compression stage to a second pressure to form a high-pressure compressed stream having a pressure of at least 1000 PSIA (68.95 bara);

(f) pumping the first cooled liquid stream to the second pressure to form a pumped first cooled liquid stream;

(g) combining the pumped first cooled liquid stream with the high pressure refrigerant stream to form a combined high-pressure refrigerant stream;

(h) cooling the combined high-pressure refrigerant stream in a second ambient cooler to form a cooled two phase high pressure refrigerant stream; and (i) expanding the condensed refrigerant stream to form the expanded refrigerant stream; and (j) selecting a refrigeration duty for each bundle of the plurality of coil wound bundles that reduces differences in an overall tube length of each bundle of the plurality of coil wound bundles as compared to each bundle of the plurality of coil wound bundles having an identical refrigeration duty.

18. The method of claim 17, wherein the expanding of the condensed refrigerant is provided by a hydraulic turbine to form the expanded refrigerant stream, wherein flow of the refrigerant in steps (a) through (i) defines a closed-loop refrigeration cycle and all of the refrigerant flows through the hydraulic turbine.

19. The method of claim 17, further comprising fabricating the system to provide the refrigeration duties selected in step (j) prior to performing step (a).

20. The method of claim 17, wherein the expanded refrigerant stream provides the sole refrigeration duty for step (a).

21. A method of designing and fabricating a system for liquefying natural gas using a closed loop single mixed refrigerant process that supplies refrigeration duty to a cryogenic heat exchanger having a plurality of coil wound bundles, each of the plurality of coil wound bundles having an overall tube length, the method comprising:

(a) selecting a refrigeration duty for each bundle of the plurality of coil wound bundles that reduces differences in the overall tube length of each bundle of the plurality of coil wound bundles as compared to each bundle of the plurality of coil wound bundles having an identical refrigeration duty; and (b) fabricating the system to provide the refrigeration duties selected in step (a);

wherein the sole refrigeration duty for the cryogenic heat exchanger is a stream of the single mixed refrigerant that has been compressed to a pressure of at least 1000 PSIA (68.95 bara) and expanded to form an expanded refrigerant stream.

* * * * *